United States Patent [19]

Lagorio et al.

[11] 4,003,470

[45] Jan. 18, 1977

[54] PAINT CHIP DISPLAY STRUCTURE

[75] Inventors: Joseph S. Lagorio, Arlington Heights; Marvin G. Kuhlman, Desplaines, both of Ill.

[73] Assignee: National Creative Merchandising Corporation, Arlington Heights, Ill.

[22] Filed: Mar. 15, 1976

[21] Appl. No.: 666,773

[52] U.S. Cl. ..... 211/50; 40/124.2

[51] Int. Cl.[2] ..... A63F 1/10

[58] Field of Search ..... 211/50, 55, 56; 40/124.2, 124.4

[56] References Cited

UNITED STATES PATENTS

| | | | |
|---|---|---|---|
| 2,879,899 | 3/1959 | Shenkin | 211/55 |
| 2,963,808 | 12/1960 | Guichard | 40/124.2 |
| 3,135,388 | 6/1964 | Lang | 40/124.4 X |
| 3,791,651 | 2/1974 | Barnum et al. | 40/124.2 X |

*Primary Examiner*—Roy D. Frazier
*Assistant Examiner*—Robert W. Gibson, Jr.
*Attorney, Agent, or Firm*—Wegner, Stellman, McCord, Wiles & Wood

[57] ABSTRACT

A paint chip display structure wherein a plurality of pocket members are arranged to define a series of vertically spaced, forwardly and upwardly opening pockets with edge retainer elements on the pocket members for receiving the side edges of a paint chip extending upwardly from a subjacent pocket with the lower portion of the paint chip removably carried by the subjacent pocket. The upper portion of the paint chip is releasably retained by the edge retainer structure to be exposed forwardly of the pocket member overlying the subjacent pocket member and may be frictionally retained therein by the springiness of the paint chip material. A control paint chip may be retained in the pocket to identify the chip to be retained in the subjacent pocket when all of the chips are removed from the subjacent pocket. The identifying chip is locked in the overlying pocket.

19 Claims, 6 Drawing Figures

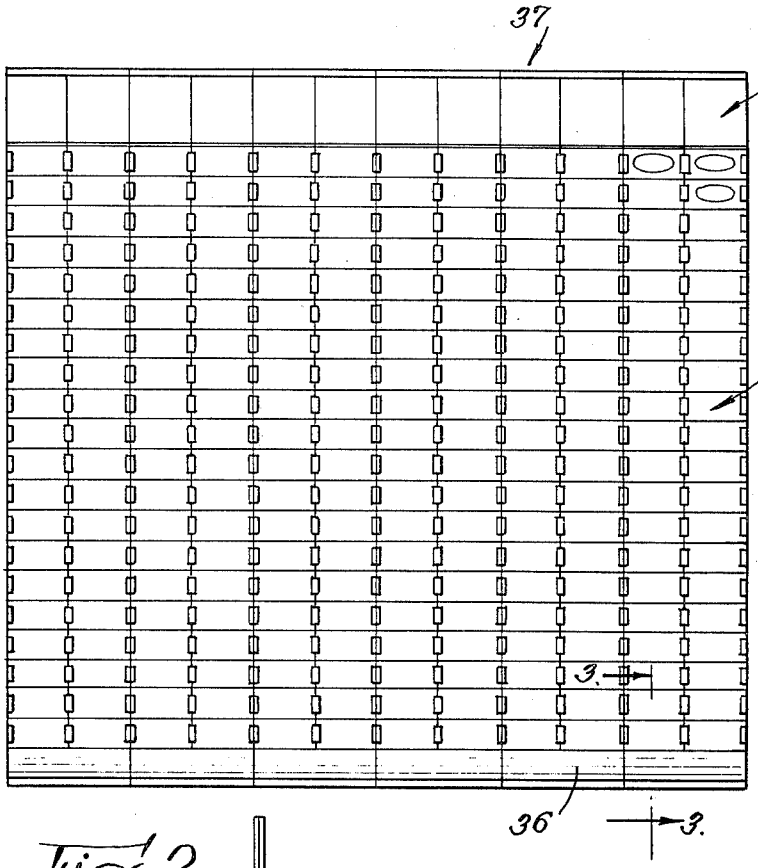
Fig. 1.
Fig. 2.
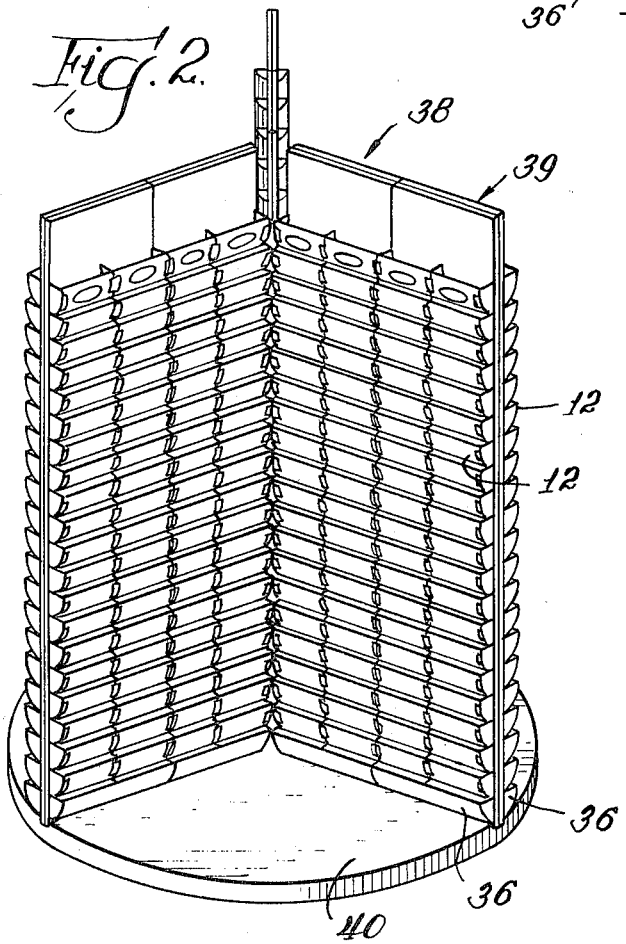
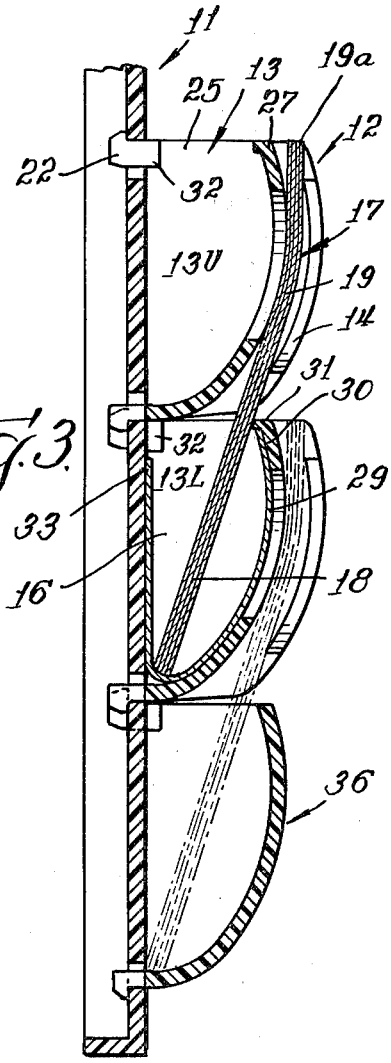
Fig. 3.

PAINT CHIP DISPLAY STRUCTURE

BACKGROUND OF THE INVENTION

1. Field of the Invention

This invention relates to display structures and in particular to paint chip display structures.

2. Description of the Prior Art

In the marketing of paint, it is desirable to provide paint chips to a prospective customer showing different colors and surface finishes corresponding to the effects obtained by the different colors and types of paint being marketed. Such paint chips conventionally comprise small pieces of heavy paper, or cardboard, having a finish on one surface coordinated with the paint intended to be represented thereby. Such paint chips may be maintained in suitable booklets, on suitable stands, or in other display devices, permitting the prospective paint customer to select one or more of the paint chips for use in determining the desirability of purchasing a quantity of paint corresponding to a selected paint chip.

One disadvantage of the known paint chip retaining means is the ability of the prospective customer to remove the last of the paint chips from the sample group so that the supply must be replenished before a further prospective customer may view a paint chip corresponding to the previously exhausted supply.

Another disadvantage of the known paint chip holders is relatively high cost and difficulty of assembly.

SUMMARY OF THE INVENTION

The present invention comprehends an improved paint chip display structure arranged to display the paint chips in a novel manner.

The display structure of the present invention is arranged to prevent the removal of the last paint chip in a given group so that, at all times, at least one paint chip is displayed for observation by a prospective customer.

Each group of paint chips may be removably carried in an improved pocket member structure wherein a lower portion of the paint chips is received in a subjacent pocket member and the upper portion of the paint chips is exposed forwardly of an overlying pocket member.

More specifically, the upper portion of the paint chips may be retained against the overlying pocket member by edge retainer means carried at opposite ends of the pocket.

The paint chips may be resiliently biased to be frictionally retained in the pocket member.

The last paint chip of each group of chips is retained in the pocket member overlying the pocket member in which the removable paint chips are carried. More specifically, each of the overlying pocket members may include control means for releasably locking the retained paint chips therein while exposing a portion of the locked-in paint chip forwardly from the pocket member when the paint chips are removed from the subjacent pocket member.

In the illustrated embodiment, the control paint chip is bent into U-shaped configuration in the overlying pocket member and defines upper edge portions, the forward one of which engages a rearwardly projecting stop shoulder on the front wall of the pocket member. The upper edge portion of the rear leg of the U-shaped configuration underlies a forwardly projecting stop shoulder on the rear wall means of the display structure. The front wall of the pocket member may be provided with a suitable opening for exposing the retained paint chip for view forwardly from the display when the paint chips are absent from the underlying pocket.

The invention further comprehends the construction of the display by means of a plurality of separable pocket members fitted to a base wall member to define the desired vertical series of pocket members. Snap fastening means may be provided for effecting the ready assembly and disassembly of the pocket members relative to the base wall member.

Thus, the paint chip dislay structure of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein:

FIG. 1 is a fragmentary front elevation of a paint chip display structure embodying the invention;

FIG. 2 is a perspective view of a modified form of paint chip display structure embodying the invention;

FIG. 3 is a fragmentary enlarged vertical section taken substantially along the line 3—3 of FIG. 1;

DESCRIPTION OF THE PREFERRED EMBODIMENT

Figure 4:
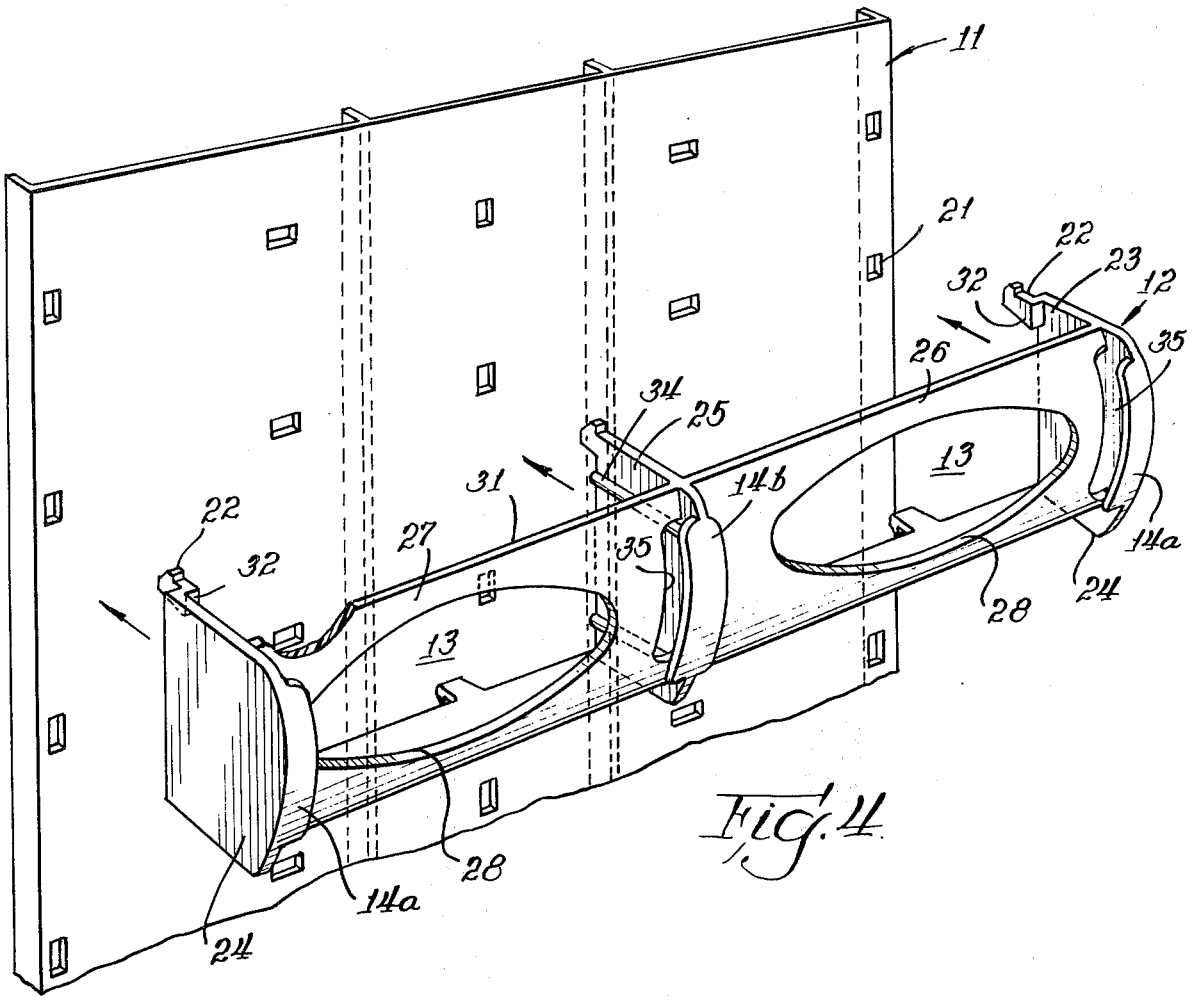
FIG. 4 is a fragmentary perspective view illustrating the assembly of the display structure.

In the exemplary embodiment of the invention as disclosed in the drawing, a paint chip dislay structure generally designated 10 is shown to comprise a plurality of upright base wall members generally designated 11 and a plurality of pocket member elements generally designated 12 which cooperate with the base wall in effectively defining pocket members forming a series of vertically spaced, forwardly and upwardly opening pockets 13.

Edge retainer means 14 are provided on the pocket member elements 12 for receiving the side edges 15 of a plurality of paint chips 16 defining a packet 17.

As best seen in FIG. 3, the lower portion 18 of the paint chips is received in a subjacent pocket 13L with the upper portion 19 of the chips retained by the edge retainer means 14 forwardly of an upper pocket 13U defined by the overlying pocket member element 12. Thus, the mid-portion 20 of the forwardmost paint chip of the packet 17 is exposed forwardly of the overlying pocket member for observation by a prospective paint purchaser. Further, the forwardmost chip of the packet 17 may be readily removed from the packet 17 by sliding the paint chip upwardly over the surface of the next rearward paint chip so as to withdraw the forwardmost paint chip from the subjacent pocket 13L and from the retaining means 14 of the overlying pocket. The natural springiness of the paint chip materials causes the paint chips to have a frictional retention tending to maintain them in the different pockets while yet permitting facilitated removal from the pockets as desired by a prospective paint purchaser.

More specifially, the base wall member 11 may comprise an upright wall member having a plurality of apertures 21 adapted to receive interlocking tongues 22 on the upper rear corner portions 23 of opposite end wall members 24 of the pocket member elements 12, as best seen in FIG. 4. As shown therein, each pocket member element 2 may define a pair of pockets 13 when assembled to the base wall member 11 with a central divider wall 25 extending between the side-by-side pair of pockets.

The edge retainers are defined by a pair of inturned flanges 14*a* at the opposite ends of the pocket member elements. In the illustrated embodiment, the flanges are formed integrally with the end walls 24. A T-flange 14*b* is provided on the center wall 25 to define the edge retainer structure thereat.

An arcuate front wall 26 extends between right side wall 24 and center wall 25 and a corresponding arcuate front wall 27 extends between center wall 25 and left side wall 24 to define the front wall means of the respective pockets 13. Each of the front walls may be provided with a suitable opening 28 for exposing an identifying chip 29 corresponding to the chips in the packet extending upwardly from the subjacent pocket to forwardly of the pocket receiving the chip 29.

As shown in FIG. 3, the identifying chip 29 may be bent to have a U-shaped, upwardly opening configuration with an upper edge portion 30 thereof received under a rearwardly projecting stop shoulder 31 extending the length of the front walls 26 and 27.

The tongues 22 may include forwardly projecting portions 32 which, as shown in FIG. 3, may overlie the upper edge 33 of the rear leg of the bent identifying chip 29 for cooperating with stop shoulder 31 in effectively retaining the identifying paint chip 29 in the pocket.

Center wall 25 may be provided with a pair of reinforcing ribs 34. The front walls 26 and 27 may be provided with suitable openings 35 to facilitate manufacture of the pocket member elements as by molding from a suitable synthetic resin.

The edge retainers are spaced forwardly of the front walls 26 and 27 suitably to receive therebetween a packet of paint chips having a substantial number of such chips therein, as illustrated in FIG. 3. The slightly bent configuration of the packet causes the chips to be held frictionally in the packet while yet permitting ready removal of the forwardmost chip by the upward sliding thereof as a result of fingertip pressure thereaganist by a prospective paint purchaser. When the last of the chips of the packet is removed, the identifying chip 29 in the overlying pocket remains therein to provide information to the prospective paint purchaser notwithstanding the inability of the paint purchaser to remove the identifying paint chip from the overlying pocket.

While the identifying chip is effectively locked in the overlying pocket, it may be removed by disengagement of the front edge 30 from the stop shoulder 31 as a result of a rearward urging of the front leg of the curved paint chip rearwardly by the movement of a person's fingers through the opening 28 thereagainst. After rearward displacement of the edge 30 is effected, the user may then grip the edge 30 rearwardly of the stop shoulder 31 to withdraw the identifying chip 29 upwardly from the pocket.

As the identifying chip may comprise one of an original packet of such chips, it is identical to the chips of the packet retained in the subjacent pocket. The natural resiliency of the paint chip material effectively retains the chip in the U-shaped configuration illustrated in FIG. 3 so as to effectively maintain the identifying chip as shown in the overlying pocket.

Figure 5:
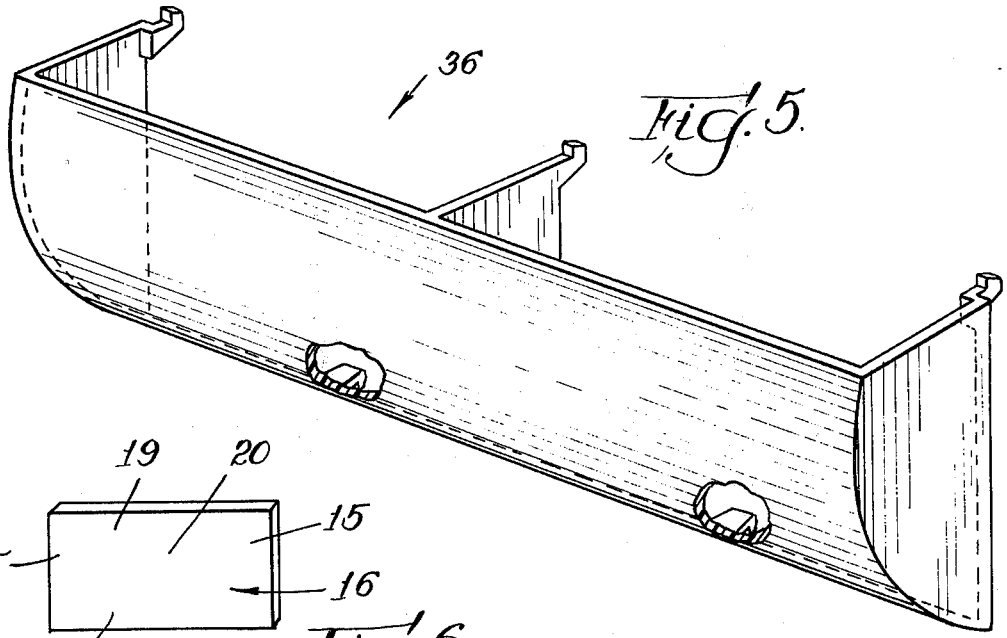
FIG. 5 is a perspective view with portions broken away illustrating the construction of the lowermost pocket member of the display structure.
Figure 6:
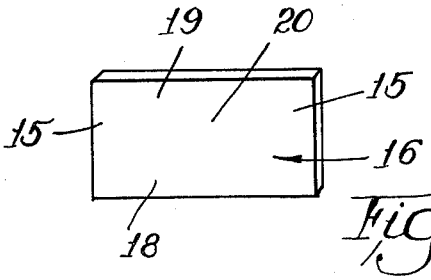
FIG. 6 is a front perspective view of a paint chip for use in the display structure.

As the lowermost pocket member element 36 does not require the provision of an identifying paint chip 29 therein (there being no subjacent pocket for carrying a packet to have the upper portion of the paint chips of the packet disposed forwardly of the lowermost pocket member element), the edge retaining means and front openings of the pocket member elements 12 may be omitted in the pocket member elements 36, as shown in FIG. 5. In all other respects, the lowermost pocket member element 36 is similar to the pocket member elements 12 and functions in a similar manner.

The display device 10 shown in FIG. 1 may be made up of a plurality of sections arranged in side-by-side disposition so as to define a relatively wide panel generally designated 37. Alternatively, as shown in FIG. 2, a modified form of device 38 may be provided wherein a plurality of pairs 39 of the display section may be provided on a base 40 which may be rotatable so as to permit selective viewing of different sections 39 from a forward position. In the turntable arrangement of FIG. 2, sets of the sections 39 may be arranged back-to-back so that a substantial number of paint chips may be effectively displayed in a relatively small space by means of the improved display device of the present invention.

As indicated above, the display device herein may be economically formed as by molding from a synthetic resin. One excellent example of such a resin is styrene resin. The structure may be molded to have a wall thickness of approximately 1/10th of an inch, with the height of the individual pocket member elements being approximately 2 inches and the length thereof being approximately 8 inches. As will be obvious to those skilled in the art, while the base wall members 11 disclosed above have a width corresponding to the individual pocket member elements, any suitable configuration of the base wall member may be provided to receive the plurality of pocket member elements in vertically stacked association.

As best seen in FIG. 3, the upper portion 19 of the paint chips is deflected rearwardly by the edge retainer means 14 so as to have an upper edge 19*a* thereof extend at least vertically so as to be readily viewable from a position forwardly and upwardly thereof. In the absence of the use of such deflecting means, the upper portions 19 would tend to be exposed downwardly requiring their viewing from below the level thereof and presenting a serious problem as to effective display of the intended coloration. More specifically, in most locations where such paint chip displays are utilized, overhead lighting is employed. Thus, if the upper paint chip portions were permitted to face angularly downwardly throughout their length, the surfaces would not be lighted efficiently by such overhead lighting. The use of the deflector means 14 herein effectively causes a rearward deflection of the upper portion of the paint chips so as to cause at least the upper edge 19a thereof to extend at least vertically so as to have improved lighting thereof by such overhead lighting means.

At the same time, the respective pocket members may be vertically related as a result of the deflection of the paint chips from the forwardly angled relationship defined by the lower portions thereof to the generally upright relationship defined by the upper portions thereof. Thus, as best seen in FIG. 3, the deflection of the upper portions of the paint chips permits the desired reception of the lower portion of the superjacent packet behind the upper portion of the subjacent packet. As further seen in FIG. 3, the deflection of the paint chips is relatively small so as to permit facilitated withdrawal of a single paint chip from the packet as desired, while yet providing a resilient biasing of the packet tending to effectively maintain the integrity of the packet while yet permitting facilitated selective withdrawal of individual chips.

The foregoing disclosure of specific embodiments is illustrative of the broad inventive concepts comprehended by the invention.

We claim:

1. A paint chip display structure comprising:

a plurality of pocket members arranged to define a series of vertically spaced forwardly and upwardly opening pockets; and edge retainer means on said pocket members for receiving the side edges of a paint chip extending upwardly from a subjacent pocket wth the lower portion of the paint chip removably carried by the subjacent pocket member and the upper portion of the paint chip releasably retained by said edge retainer means to be exposed forwardly of the pocket member overlying the subjacent pocket member for receiving from forwardly and upwardly thereof.

2. The paint chip display structure of claim 1 wherein said pocket members include releasable securing means for removably securing the pocket members to a base wall member.

3. The paint chip display structure of claim 1 wherein said pocket members define generally cylindrical, axially horizontal front walls, said upper portion of the paint chip being urged against said front wall by the edge retainer means.

4. The paint chip display structure of claim 1 wherein said edge retainer means comprises inturned flanges at the opposite ends of each pocket.

5. The paint chip display structure of claim 1 wherein said edge retainer means comprises inturned flanges at the opposite ends of each pocket and having a vertical extent less than that of said pocket members.

6. The paint chip display structure of claim 1 further including a bottom pocket member disposed subjacent the lowest one of said vertical series of first named pocket members and being without said edge retainer means of said first named pocket members.

7. The paint chip display structure of claim 1 including an upright base wall and means on said pocket members and base wall for removably mounting said pocket members thereto whereby said base wall defines a rear wall portion of said pockets.

8. A paint chip display structure comprising:

a plurality of pocket members arranged to define a series of vertically spaced forwardly and upwardly opening pockets;

edge retainer means on said pocket members for receiving the side edges of a paint chip extending upwardly from a subjacent pocket with the lower portion of the paint chip removably carried by the subjacent pocket member and the upper portion of the paint chip releasably retained by said edge retainer means to be exposed forwardly of the pocket member overlying the subjacent pocket member; and control means on said pocket members for releasably locking a paint chip therein and exposing a portion of the locked-in paint chip forwardly from the pocket thereof when paint chips are absent from the subjacent pocket member.

9. The paint chip display structure of claim 8 wherein said pocket members define a front wall and said control means include an opening in said front wall through which the locked-in paint chip is viewable when paint chips are absent from the subjacent pocket member.

10. The paint chip display structure of claim 8 wherein said pocket members define a front wall and said control means include a rearwardly projecting shoulder on the front wall for engaging a front upper edge of a paint chip received in the pocket rearwardly of the front wall.

11. The paint chip display structure of claim 8 wherein said pocket members define a front wall and said control means include a rearwardly projecting shoulder on the front wall for engaging a front upper edge of a paint chip received in the pocket rearwardly of the front wall and a forwardly projecting shoulder at the rear of the pocket for engaging a rear edge of the paint chip received in the pocket.

12. The paint chip display structure of claim 8 wherein said pocket members define a front wall and said control means include a rearwardly projecting shoulder on the front wall for engaging a front upper edge of a paint chip received in the pocket rearwardly of the front wall and a forwardly projecting shoulder at the rear of the pocket for engaging a rear upper edge of the paint chip received in the pocket.

13. The paint chip display structure of claim 8 wherein the locked-in paint chip comprises a chip corresponding to the chips intended for storage in the subjacent pocket whereby the forward exposure of the chip as a result of the absence of chips in the subjacent pocket identifies the absent paint chips for facilitating refilling of the empty pocket with the correct previously inserted type of paint chip therein.

14. The paint chip display structure of claim 8 including an upright base wall and means on said pocket members and base wall for removably mounting said pocket members thereto whereby said base wall defines a rear wall portion of said pockets.

15. A paint chip display structure comprising:

a plurality of pocket members arranged to define a series of vertically spaced forwardly and upwardly opening pockets; and deflector means on said pocket members for rearwardly deflecting the upper portion of a paint chip having a lower portion removably carried by the subjacent pocket member and with said upper portion of the paint chip being exposed forwardly of the pocket member overlying the subjacent pocket member for receiving from forwardly and upwardly thereof.

16. The paint chip display structure of claim 15 wherein said pocket members define arcuate front walls, said upper portion of the paint chip being urged against said front wall by the deflector means.

17. The paint chip display structure of claim 15 wherein said deflector means comprises inturned flanges at the opposite ends of each pocket.

18. The paint chip display structure of claim 15 wherein said deflector means comprises inturned flanges at the opposite ends of each pocket and having a vertical extent less than that of said pocket members whereby the upper edge of the paint chip is undeflected.

19. The paint chip display structure of claim 15 wherein said deflector means comprises inturned flanges at the opposite ends of each pocket and having a vertical extent less than that of said pocket members whereby the upper edge of the paint chip is undeflected and extends substantially vertically.

* * * * *